United States Patent [19]

Horais

[11] Patent Number: 4,715,306

[45] Date of Patent: Dec. 29, 1987

[54] CATAMARAN WITH A STEERABLE CENTERBOARD APPARATUS AND AN IMPROVED DECK JOINT

[76] Inventor: Alan W. Horais, 1603 Steinhart Ave., Redondo Beach, Calif. 90278

[21] Appl. No.: 848,305

[22] Filed: Apr. 4, 1986

[51] Int. Cl.[4] ..... B63B 1/00

[52] U.S. Cl. ..... 114/61; 114/354; 114/39.2

[58] Field of Search ..... 114/61, 123, 127, 128, 114/130, 131, 132, 140, 144 R, 162, 292, 352, 354, 39; 441/35

[56] References Cited

U.S. PATENT DOCUMENTS

| | | | |
|---|---|---|---|
| 2,712,293 | 7/1955 | O'Higgins | 114/354 |
| 3,731,645 | 5/1973 | Pearce | 114/162 |
| 3,883,909 | 5/1975 | Fisher et al. | 114/352 |
| 4,003,328 | 1/1977 | Feldman | 114/144 R |
| 4,136,414 | 1/1979 | Popkin | 114/61 |

FOREIGN PATENT DOCUMENTS

| | | | |
|---|---|---|---|
| 2510509 | 2/1983 | France | 114/123 |
| 1375865 | 11/1974 | United Kingdom | 114/352 |

*Primary Examiner*—Sherman D. Basinger

*Assistant Examiner*—Jesûs D. Sotelo

[57] ABSTRACT

A catamaran with a steerable centerboard apparatus includes a housing rotatably mounted on the deck of the catamaran. A centerboard is pivotally mounted to the housing to permit movement between an upper and lower position. A tiller, integral with the housing, extends over the upper surface of the deck and includes an elastic band or rope attached to its end and a hook located on the deck. This inexpensive device keeps the tiller self-centered when not in use. When the user wishes to maneuver the catamaran, he simply turns the tiller in the proper direction with his hand or foot. The improved deck joint comprises a tab extending from deck which fits and mates with a recess located on the hull. The tab is formed to fit snuggly within the recess so that lateral movement is eliminated. Also, a projection located on the lower surface of the tab is received within a cavity extending in the surface of the hull recess. A pair of straps including a seatbelt type buckle are located on each side of the recess. One strap extends into a slot located on the deck and is buckled to the other strap to properly secure the deck and hull together.

11 Claims, 7 Drawing Figures

FIG. 5
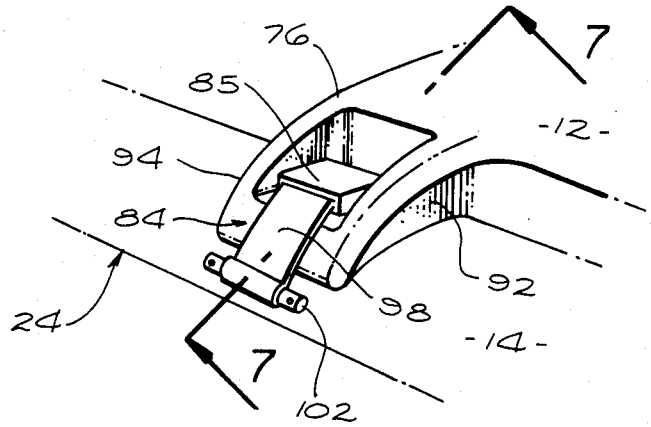
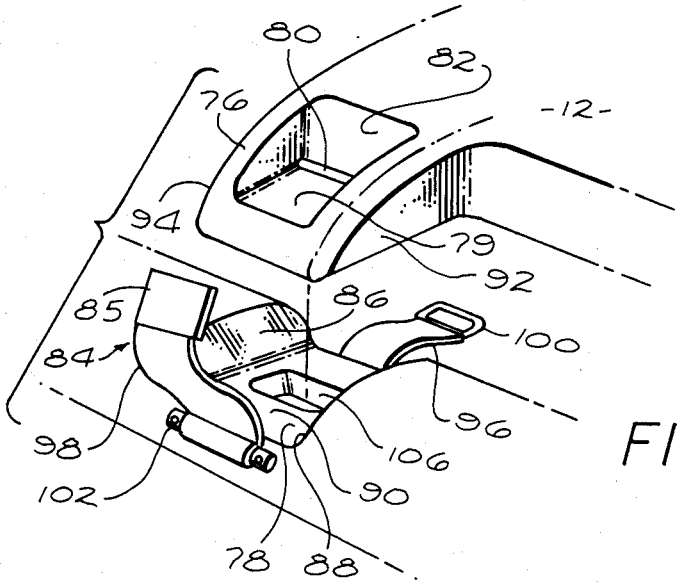
FIG. 6
FIG. 7
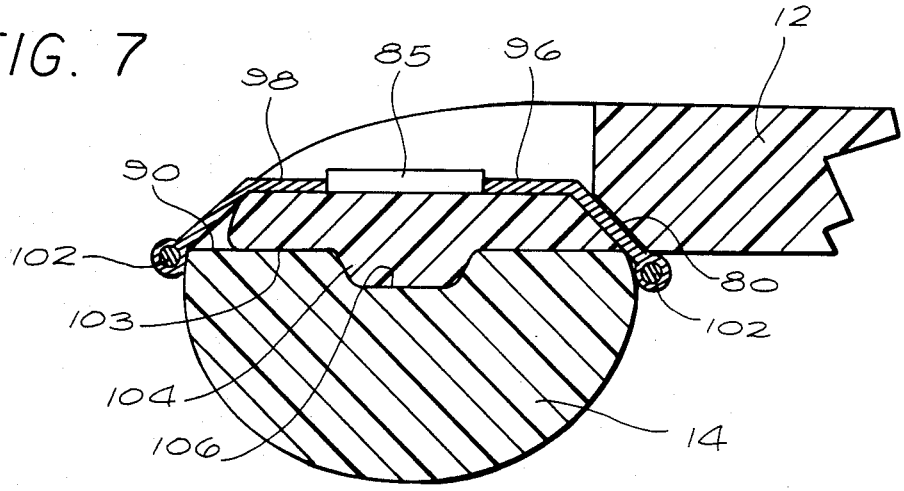

CATAMARAN WITH A STEERABLE CENTERBOARD APPARATUS AND AN IMPROVED DECK JOINT

BACKGROUND OF THE INVENTION

1. Field of the Invention

The present inventions relate generally to the construction of water going vessels and more particularly to a catamaran having a steerable centerboard apparatus and an improved deck joint for securing the deck portion and hulls together.

2. Prior Art

Catamarans are well-known sailing vessels that by definition consist of a horizontal deck mounted on a pair of parallel hulls. The hulls are usually placed on opposite sides of the deck to provide a relatively stable craft. The use of the two spread apart hulls reduces the overall weight of the craft, thus increasing its overall speed. The width of each hull is usually very narrow to reduce the amount of drag on the craft, again increasing the speed of the craft. The sails that propel the catamaran usually provides ample power to move the catamaran on any body of water such as a pond, lake, river or ocean.

Most catamarans are constructed as a three piece unit that can be readily assembled by the user just prior to use. While some larger catamarans are constructed in a unitary fashion, i.e., the deck is permanently fastened to the hulls, most catamarans are recreational vessels that are required to be transported to the place of use on the tops of automobiles, vans and the like. This generally requires the user to assemble the craft when he reaches his destination and then to disassemble the craft when finished. Therefore, the catamaran has to be relatively easy to assemble.

The design of the catamaran permits its user to sit on the deck while manipulating the sail with his hands. Generally, steering is accomplished by maneuvering the sail with the direction of the wind to propel the craft to the desired location. Most catamarans are also equipped with rudders located at the stern of both of the hulls to aid in steering the craft. Generally, when one wishes to make a slight maneuver with the catamaran, one merely turns the tiller attached to both rudders to move the rudders in the proper direction. However, when a sharp and sudden turn is required, one must usually properly position the sail with the wind and simultaneously turn the rudders to accomplish a successful sharp turn. This type of turn requires substantial skill in order to do these steps simultaneously. A mistake on the part of the sailor can result in the catamaran flipping over.

In order to provide greater stability to the catamaran, another device, namely a daggerboard, centerboard or keel, is placed beneath the middle of each hull where it extends vertically down into the water to help prevent the catamaran from slipping sidways. The daggerboard, centerboard or keel is a long, flat board which is placed with its broad surface parallel to the longitudinal axis of the hulls of the craft. The daggerboard, centerboard or keels are thus useful in reducing sideways drift induced by the wind and sail interaction. The daggerboard, centerboard or keels are also helpful in "anchoring" the middle of the catamaran when making sharp turns. Without the centerboard, the catamaran is susceptible to so much lateral movement that the the craft cannot be tacked upwind under extreme conditions.

It is important to note the catamarans typically utilize fixed rigging with masts tied to both hulls. As a result, catamarans tip to one side when sailed and are frequently sailed with one hull out of the water. This tilted attitude thus requires that each hull be equipped with a rudder and daggerboard, centerboard or keel.

Our invention relates to catamarans with rigging that can be adjusted to allow both hulls to remain in the water essentially without tipping to the side.

One of the major drawbacks in prior art catamarans is the difficulty in steering the craft. Generally, on larger sized catamarans, steering requires considerable sailing skills and expertise on the part of the user. This can be a serious drawback to the novice or intermediate sailor who lacks most of these necessary skills. The major problem in steering the catamaran is that the sailor usually has to use both hands to work the sail but yet needs another hand to turn the tiller. On larger sized catamarans, the sail can be so difficult to manage that two people would be required to maneuver the boat; one to handle the sail and the other to steer the rudder. This can cause obvious problems to the user who wishes to sail alone.

The drawbacks in steering the catamaran are heightened if the user wishes to stand on the deck of the catamaran and sail the vessel much like a sailboard. Since a catamaran cannot be steered by shifting body weight and the sail as can be done with a sailboard, a specific steering mechanism would be needed. A rudder located on the hull would not be satisfactory since the user's hands would remain on the sail rigging during use. Therefore, another person would have to steer the rudder while the other person holds the sail. Therefore, there is a need for a new device which permits the user to simultaneously turn the rudder while holding the sail.

Additional drawbacks found on most conventional catamarans included the difficulty in assembling and dissembling the the hull and deck units. As previously mentioned, most smaller recreational catamarans are constructed in a three piece assembly to facilitate transportation of the craft. Once the user reaches his destination, such as a beach or lake, he is required to put the unit together. This generally requires that the catamaran be rather simple to put together, since most people do not possess the mechanical skills needed to assemble a complex unit. Further, most people do not want to carry the tools needed to fasten the hull and deck portions together. Also, fastening devices such a nut and bolt assembly or similar fasteners are generally avoided since they can be easily lost in the sand or water during assembly or later when the device is in the water. Therefore, there is a need to create a catamaran which is quick and easy to assemble but yet possesses the necessary stability and rigid construction for sailing through even the roughest of water.

SUMMARY OF THE INVENTION

While prior art catamaran sailing vessels are generally useful and fun to sail, these vessels have limitations and disadvantages as illustrated above which are serious drawbacks. The present invention has as its objective the elimination of these and other disadvantages by providing a steerable centerboard which can also be used as a rudder. While we believe this invention relates to all catamarans, it is of particular advantage of small catamarans that have the capability of rigging that can be tilted to windward thus allowing both hulls to remain in the water at all points of sail (i.e. upwind reaching and downwind). The steerable centerboard is advantageous since it eliminates the need for an additional rudder(s) since the centerboard itself is used to steer the vessel. The steerable centerboard is also self-centering so that when the tiller of the unit is not in use, the centerboard is maintained in an aligned, longitudinal position. This advantageous, self-centering feature of the steerable centerboard permits the centerboard to be used as a stabilizer unitl the catamaran is desired to be maneuvered. The use of the steerable centerboard apparatus also permits the user to use his feet to move the tiller since the centerboard is attached to the aft end of the deck. The tiller is designed to extend over the surface of the deck where it is accessible to either the user's hands or feet. By permitting one's feet to steer the craft, one can stand on the deck of the catamaran and use both hands in operating the sail assembly. By utilizing a means for maintaining the centerboard in its aligned position when the tiller is not being used, the vessel will sail in a straight course until such time as the user desires to turn the craft. The user can do this by simply moving the tiller by his hands or feet.

Another objective of the present invention is to provide an easy mounting joint between the deck and hull assemblies which simplifies the assembly of the catamaran. A further objective of the present invention is to eliminate the need for fasteners, such as nut and bolt assemblies, to secure the hull and deck together. The present invention also eliminates the need for special tools and mechanical skills when assembling and disassembling the unit. In one preferred embodiment of the present invention, the joint takes on a simple construction which utilizes a tab-like structure extending from the deck portion that fits within a pre-defined recess on the hull. The recess on the hull has a further cavity which receives a projection located on the bottom side of the tab-like structure on the deck to prevent lateral movement between the hull and deck during use. The hull has attached to it a pair of straps or belts which include a fastening means such as a conventional automobile seat belt-type buckle. One strap is placed through a slot located on the tab and is fastened to the other strap via the buckling device. This keeps the deck and hull units tightly together during use. When the catamaran is desired to be disassembled, the buckle is released so the hulls can be removed from the deck. This advantageous mounting joint produces a hull and deck assembly which is easy to assemble and disassemble and which can be manufactured more easily and at a reduced expense. The advantageous mounting joint also eliminates the need for loose fasteners which can be easily lost or misplaced.

One form of the present invention comprises a steerable centerboard apparatus which can be easily mounted to the aft portion of the deck of a conventional catamaran. The invention includes a housing which is pivotally mounted on the deck of the catamaran. The houisng has a board (centerboard) attached thereto which is also pivotly mounted to the housing. The housing also includes a tiller which extends into the deck portion of the catamaran where it can be manually moved to steer the craft. An elastic means, such as a spring or elastic rope or band, is attached to the end of the tiller and is fastened to a hook located on the deck portion of the boat. This elastic means keeps the centerboard self-centered so that the board remains in a straight position when no external forces are applied to the tiller. This permits the catamaran to sail in a straight course until the tiller is turned.

The board is also pivotly mounted to the housing so that it can pivot about an axis perpendicular to the direction of the catamaran. The board is capable of being fixed between an upper position in which the board is usually out of the water and a lower position in which the board extends perpendicular to the plane of the deck. The lower position is generally the position the centerboard is maintained at during use. The board can be held in the upright position by the use of a biasing element such as an elastic band which is attached to an upper portion of the board and an upper portion of the housing. The elasticity of the bands keeps the board in the upper position. A downhaul rope is also attached to the board and extends into the housing so that when it is pulled, the board will extend downward into the water to its lower position. The downhaul rope extends up through an opening in the deck through a bore in the housing to an upper surface, where a cleat to control the downhaul rope is provided. The cleat prevents the downhaul rope from moving from its preset position relative to the housing. Once the downhaul rope is pulled, the elastic band stretches to provide constant tension on the downhaul rope, thus eliminating any play in the mechanism. This also allows for some fore and aft adjustment to the board depending on where the downhaul rope is cleated.

The present invention also includes a mounting joint which helps secure the deck of the catamaran to the two hulls. Generally, the means for easily connecting and disconnecting the hull and deck portions together comprises a recess located on the hull which is specifically formed to mate which a portion of the deck. In one embodiment of the invention, the deck is formed with a tab structure extending from the side of the deck. This tab is designed to fit and mate within the recess located on the hull of the boat. The recess on the hull is formed to specifically receive the shape of the tab and includes a pair of sidewalls and a connecting portion between the sidewalls. Also, at least one projection on the lower surface of the tab is provided to fit within a cavity located on the connecting portion of the recess. This prevents the deck from slipping laterally from the hull during use. Also, a pair of straps or belts, each including an automobile type saftey belt buckle, are attached to the sides of the recess. One strap is extended through a slot located in the tab and is connected to the other strap via the seat belt type buckle to keep the hull and deck secure during use. When the catamaran is desired to be taken apart, the buckle is simply released and the hulls can then be removed from the deck.

Each hull usually has two such recesses and each side of the deck has at least two such tabs to properly secure the deck to the hull. Of course, it is possible to form any number of these tabs on the deck and as many recesses to receive these tabs on the hulls. This would, of course, provide a more stable and stronger construction.

The result of using the steerable centerboard produces a steering apparatus thus can be used by one's feet in steering the catamaran. This permits the user to utilize both of his hands in operating the sail. Also, the present invention eliminates the need for additional rudders on the hulls of the catamaran and thus provides a dual function for the centerboard. The centerboard is also self-centering so that it will remain in its initial aligned position until the user is ready to steer it. The improved joint for connecting the deck and hulls together provides a simple construction which is quick and easy to assemble and disassemble. It also provides for a joint which does not require any additional fasteners or special tools to assemble the catamaran. Furthermore, the mounting joint provides an advantageous joint which is relatively simple to manufacture, much more reliable and easy to assemble than conventional hull and deck joints, and is relatively inexpensive to manufacture.

BRIEF DESCRIPTION OF THE DRAWINGS

A complete understanding of the present inventions and other advantages and features thereof may be grained from a consideration of the following description of the preferred embodiments taken in conjunction with the accompanying drawings in which:

FIG. 5 is a perspective view showing the deck joint as assembled.

FIG. 6 is a perspective view showing the dissembled deck joint.

FIG. 7 is an enlarged cross-sectional view of the embodiment shown in FIG. 5 taken along line 7—7.

DETAILED DESCRIPTION OF THE PREFERRED EMBODIMENTS

Figure 1:
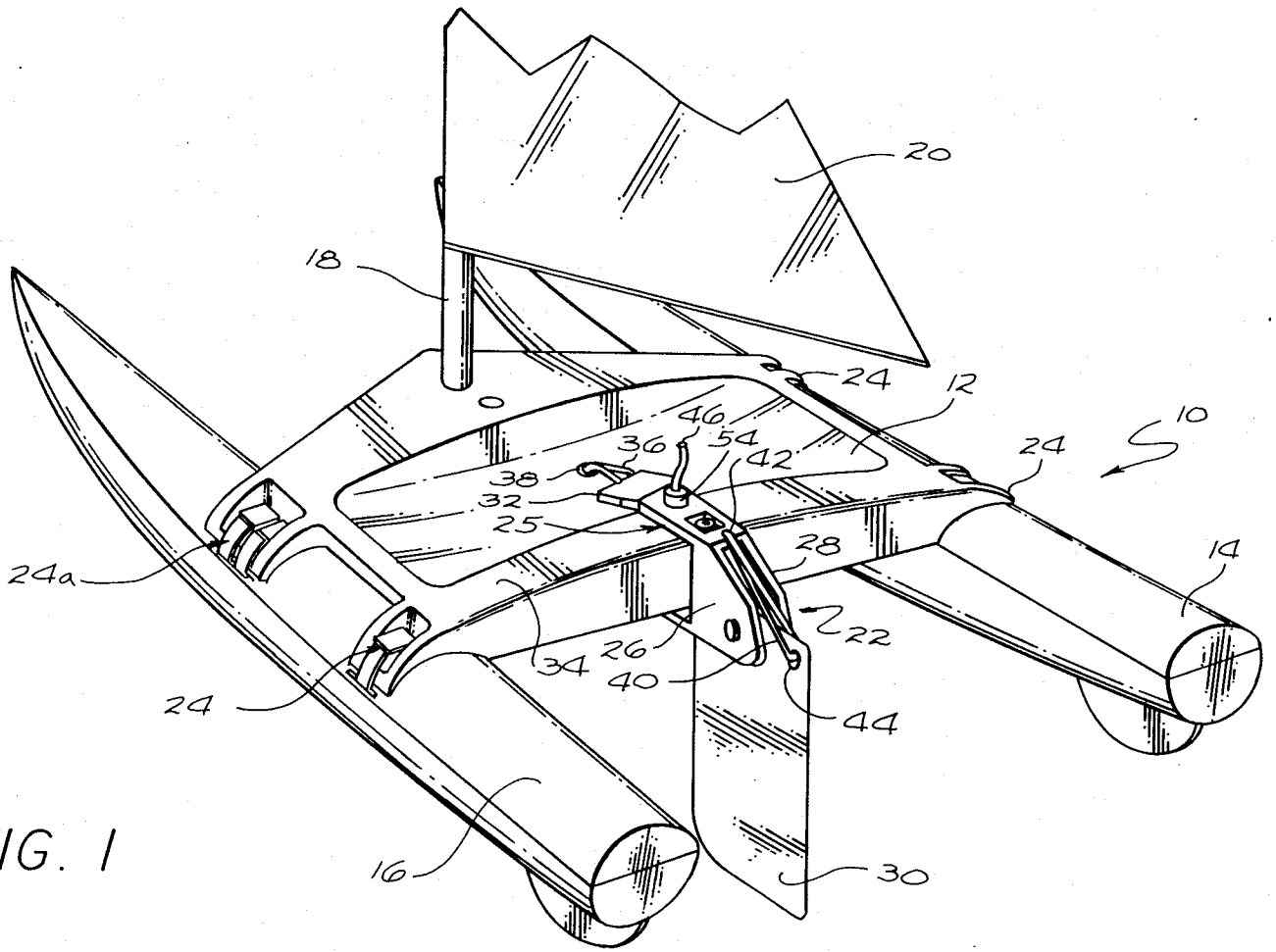
FIG. 1 is a perspective view of the preferred embodiments of the present invention.

While the present inventions ae susceptible of various modifications and alternative constructions, the embodiments shown in the drawings will herein be described in detail. It should be understood, however, that it is not the intention to limit the inventions to particular forms disclosed; but, on the contrary, the intention is to cover all modifications, equivalences and alternative constructions falling within the spirit and scope of the inventions as expressed in the appended claims.

Referring initially to FIG. 1, a catamaran 10 is shown having a deck portion 12 and a pair of parallel hulls 14 and 16 attached to the sides of the deck. A mast 18 with a sail 20 is mounted near the bow of the deck. A steerable centerboard apparatus 22 in accordance with the present invention is shown as it is mounted on the aft end of the deck 12. The improved deck joint 24 in accordance with the present invention is also located on the sides of the deck 12 where the hulls 14 and 16 are attached to the deck.

Figure 2:
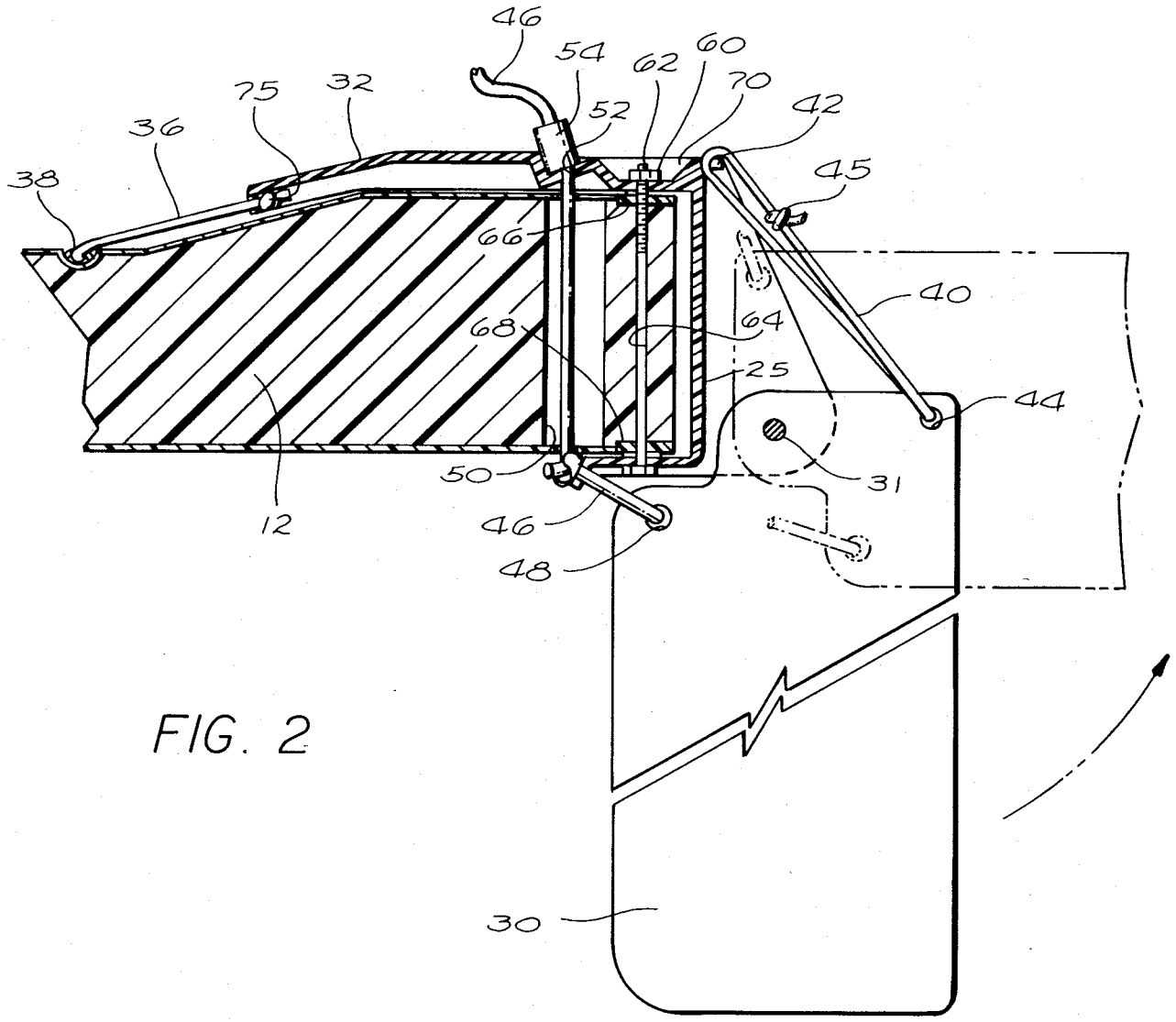
FIG. 2 is an enlarged, partially cross-sectional view of the steerable centerboard apparatus as is shown in its upper and lower positions.

Referring now to FIGS. 1 and 2, the advantageous steerable centerboard apparatus 22 used in connection with the catamaran is shown as a housing 25 being rotatably mounted to the deck of the catamaran. The housing 25 is formed having a pair of rearwardly extending parallel plates 26 and 28 which act much like a bracket. A board (centerboard) 30 is positioned between the parallel plates of the housing 25 and is fastened by a fastening device, such as a nut and bolt assembly or a solid rivet 31, to allow the centerboard to be pivotable between an upper or lower position. In FIG. 1 and in the solid line in FIG. 2, the centerboard 30 is shown as it is maintained in its lower position; the broken lines in FIG. 2 show in phantom the centerboard 30 as it appears in its upper position. The housing 25 is an integral unit that also includes a tiller 32 which extends over the upper surface 34 of the deck where it can be easily reached by the user. A biasing element such as an elastic rope or band 36 is attached to the forward end of the tiller 32 and is fixed to a hook 38 mounted to the deck 34. (Also see FIG. 3). The elastic rope 36 maintains the tiller 32 and centerboard 30 in an aligned, centered position permitting the catamaran to sail a straight course until the tiller 32 is turned by the user. Thus, a very simple and inexpensive means is provided for self-centering of the centerboard.

Figure 4:
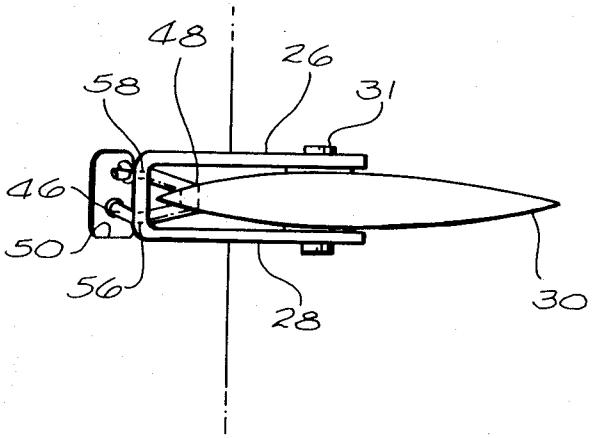
FIG. 4 is a bottom view of the steerable centerboard apparatus as attached to the aft portion of the deck.

A second biasing element, such as an elastic band or rope 40 extends between an upper bore 42 in the top of the housing and a bore 44 located in the centerboard. This elastic rope 40 helps keep the centerboard in an upright position usually out of the water until it is ready to be used. Generally, the elastic rope 40 is joined together at the knot 45 (shown only in FIG. 2), however, the rope can be joined together using any other means. A downhaul rope 46 is also attached to the centerboard through a bore 48 and extends up through a transverse slot opening 50 (also see FIG. 4) in the deck and a bore 52 in the housing. A cleat 54 is attached to the rope and is provided to hold the rope at the desired position. As is shown in FIGS. 2 and 4, the downhaul rope extends through the opening 50 and then through an opening 56 adjacent the bracket plate 28 before extending through the bore 48 located in the centerboard. The rope is run back through another hole 58 located in the housing adjacent the bracket plate 26 after which the rope is knotted to secure it in place. The traverse slot opening 50 prevents the rope from binding when the tiller is moved. Thus, another very simple, reliable and inexpensive means is provided for raising and lowering the centerboard.

Referring again FIG. 2, a nut 60 and elongated bolt 62 assembly connects the housing 25 pivotally to the deck through a bore 64 located in the deck. A pair of mounting pads 66 and 68 are located between the housing and the deck since these surfaces are in constant frictional contact. These mounting pads 66 and 68 allow the housing to pivot about the deck. The nut 60 and the end of the bolt 62 are located in a recess 70 located on top of the housing. This recess 70 helps prevent the end of the bolt from coming in contact with the user's hand or foot.

Figure 3:
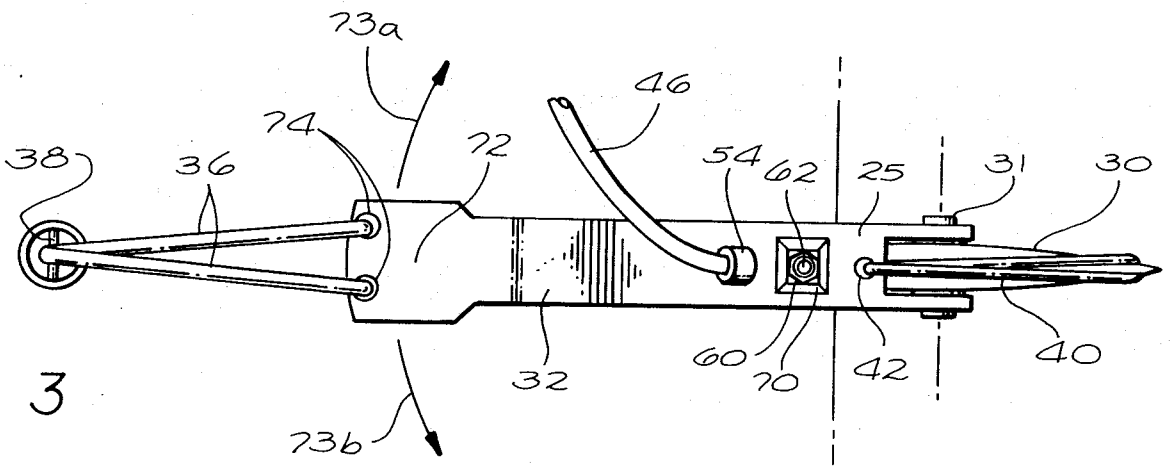
FIG. 3 is a top view of the steerable centerboard apparatus as attached to the aft portion of the deck.

Referring now to FIG. 3, a top view of the steerable centerboard apparatus is shown as it is mounted to the deck. The tiller 32 is shown including a foot pad 72 at its end which enables the user to turn the tiller by simply using his foot. The arrows **73*a* and 73*b* indicate the direction in which the tiller can be turned. The elastic rope 36 connected at the end of the tiller and fastened to the hook 38 on the deck keeps the tiller aligned and parallel to the longitudinal axes of the hulls when the tiller is not being moved by the user. The elastic rope or band is connected to the tiller through holes 74 located on the tiller, although any other suitable fastening means may be used. A knot 75 in the elastic rope 36 prevents the elastic rope from slipping through the holes 74**.

Referring now to FIGS. 5 and 6, one of the improved deck joints 24 is shown as it is assembled to keep the hull attached to the deck. The deck joint 24 consists of a tab 76 extending from the deck 12 which is received within a recess 78 located on the hull 16. The tab 76 is specifically designed to mate with the recess 78 of the hull so that a snug fit is achieved. It should be appreciated that the tab formed on the deck is only a preferred form of the present invention and need not take the form shown in FIGS. 1, 5, 6 and 7) to properly practice the present invention. The scope and spirit of the claims merely calls for a portion of the deck (generally located along its edge) to be formed to fit and mate with the shape of the recess formed on the hull. Once the deck is mated with the recess on the hull, the connector means (the strap connector herein described) can be utilized to maintain the deck and hull securely together.

Another recess 79 is formed in the upper surface of the tab 76. At the intersection with its vertical wall 82, a slot 80 extending through the tab is formed for one member of the strap connector 84 to extend through. The hull recess 78 is shown having a pair of sidewalls 86 and 88 with a substantially flat connecting portion 90 between them. The recess sidewalls 86 and 88 are designed to mate with and abut against at least a portion of the sides 92 and 94 of the tab, thus preventing lateral movement of the deck relative to the hull during use.

To further secure the mating tab and hull recess, there is located on a lower surface 103 of the tab at least one projection 104 which fits within a cavity 106 formed in the flat connecting surface 90 of the hull recess. FIG. 7 shows a cross-sectional view of the tab and recess which shows how a projection 104 rests within the cavity 106. The projection is placed on the tab to also help inhibit any type of movement of the tab within the hull recess. It should be appreciated that the shape of the projection need not take the form appearing in FIGS. 6 and 7 but rather can be any type of configuration which will serve the intended purpose.

Located at both ends of the hull recess are the two portions of the strap connector 84 comprising a first strap 96 at the end of which is a male fitting 100 and a second strap 98 having at its end a seat belt type buckle 85 or female fitting. The straps are secured to the hull using tie down fasteners 102 which are placed in loops in the straps at the end opposite the fittings and are then permanently fastened to the hull. In use, the first strap 96 is extended through the slot 80 located on the tab and is fastened to the buckle 85 carried by the second strap 98. The buckle 85 itself rests within the tab recess 79 to prevent it from accidentally becoming unfastened during use. Once the two fittings are fastened, the deck cannot be removed from the hull until the buckle is purposefully released. This arrangement securely connects the hull and the deck in a simple, reliable and inexpensive manner while allowing for easy assembly and disassembly of the boat. This arrangement also eliminates the need for fasteners such as nuts and bolts to secure the deck and hull together since the means for easily connecting and disassembling the deck and hull are permanently fastened to these units.

Referring back to FIG. 1, another embodiment of the deck-hull attachment invention is shown in the form of a double strap connector **24*a*. The tab and recess may be constructed wider than the single joint in order to accommodate the pair of buckles and straps. The slot on the tab may be one long continuous slot or there may be two smaller slots with each receiving a strap. Also, a plurality of projections may be placed on this larger tab to create a sturdier unit. Thus, this double strap connector 24*a*** provides the same function as the other embodiment of the invention, the only difference being in the width of the tab.

In the preferred embodiments, the deck and hull can be made of a rigid plastic by any common plastic molding process such as injection or vacuum forming or they can be made with fiberglass. The tabs located on the deck are formed using one of the same plastic molding methods. It should be appreciated that the shape of the tabs need not be rectangular, but rather may be any desired shape which will maintain the tabs securely within the hull recesses. Of course, the recesses must be formed to fit the shape of the tabs. Therefore, it is preferrable to use a shape which will provide best lateral stability to the unit. Additionally, the projection formed on the underside of each tab is again preferrably made as a unitary structure with the tab. This prevents extra parts and loose fits. However, this is not the only way to place the projection on the tab, any other method can be used which keeps the projection permanently mounted on the lower surface of the tab. Again, the shape of the projection need not be that as shown in FIGS. 6 and 7, but rather can be any shape which will provide the desired result. For example, the projection may have a cylindrical shape which would be received within a cylindrically shaped cavity formed in the hull recess.

The straps of the deck joint can be made from a standard seat belt material or any material which possess the necessary material strength and water resistance. It will be appreciated that any type of buckle means can be used with the straps, provided that proper tension can be placed on the strap to maintain the hull and deck in proper contact. Also, the materials should resist water and corrosion.

The steerable centerboard apparatus can be made out of a rigid plastic material, a sturdy metal or fiberglass. For example, the housing may be made from a plastic injection molding process which produces a hardened plastic that can withstand the appropriate forces which would act on the housing. The centerboard can be made from wood, plastic or fiberglass or any other sturdy material which will withstand the rigors of sailing. The downhaul rope, elastic bands and ropes are all commercially available items which can be easily obtained. It should be noted that the tiller need not be shaped as is shown in FIGS. 1 and 3. However, this form is preferred because it provides a tiller with ample length for the user. Of course, the length of the tiller can be extended or shortened without departing from the spirit of the invention.

When using the deck and hull joint, the deck is initially placed on one of the hulls to permit the straps to be joined in place. The deck is initially placed so that it fits within the corresponding recess formed in the hull. Once the hull and deck have been joined by placing the deck upon the hull, the strap can be placed through the slot on the tab and buckled in place. When the unit is desired to be disassembled, the buckles are simply released, whereupon the deck can be separated from the hulls.

In using the steerable centerboard apparatus, the centerboard is generally held in the upper position out of the water due to the elastic band which is placed along the top of the housing. When the centerboard is desired to be lowered into the water, the downhaul rope is grasped by the user and pulled upwardly. Thereupon, the rope may be placed in the position along the cleat to maintain the centerboard in the desired position. The present invention is also capable of setting the location of the centerboard between the upper and lower positions by merely moving the rope and cleating the rope at the desired position.

When the user wants to execute a turn, he merely pushed the tiller in the proper direction. When the tiller is not being used, the elastic band keeps the tiller aligned with its narrowest profile facing the direction of travel. The catamaran will then proceed on a straight course until it is ready to be maneuvered. Thus, this advantageous steerable centerboard apparatus allows the centerboard to be used both as a conventional centerboard and as a rudder.

Thus, there has been illustrated and described a unique and novel steerable centerboard apparatus and deck joint which fulfills all of the objects and advantages set forth. It should be understood that many changes, modifications, variations and other uses and applications will become apparent to those skilled in the art after considering this disclosure and accompanying drawings. Therefore, any and all such changes, modifications, variations and other uses and applications which do not depart from the spirit and scope of the inventions are deemed to be covered by the inventions which are limited only by the following claims.

What is claimed is:

1. A steerable centerboard apparatus for a water going vessel having a deck with an opening extending therethrough, the deck being mounted to at least one hull, comprising:

a housing rotatably mounted to the deck of the vessel, said housing having a bore defined therethrough;

a board pivotally attached to said housing;

a tiller integral with said housing and extending into said deck, said tiller being movable by a user of said vessel for rotating said housing and said board about an axis substantially perpendicular to the direction of travel of said vessel, said board being pivotally attached to said housing about an axis perpendicular to this first-mentioned axis;

means for maintaining said tiller in a pre-defined position until a user of said vessel is ready to move said tiller;

a biasing element attached to an upper portion of said board and to said housing;

a rope attached to said board, said rope extending through said opening in said deck and through said bore in said housing, wherein said board can be moved from an upper position to a lower position by moving said rope through said opening and said bore; and means for fixing said rope to said housing.

2. The steerable centerboard apparatus of claim 1 wherein said maintaining means comprises a biasing element attached to said tiller and said deck of said vessel.

3. The steerable centerboard apparatus as defined in claim 2 wherein said biasing element comprises an elastic rope.

4. The steerable centerboard apparatus as defined in claim 2 wherein said biasing element comprises an elastic band.

5. The steerable centerboard apparatus as defined in claim 2 wherein said deck includes a hook-like attachment, said biasing element being attached to said hook.

6. The centerboard as defined in claim 1 wherein said fixing means comprising a cleat attached to said housing to prevent said rope from moving from said housing.

7. A catamaran comprising:

a pair of generally parallel hulls, each hull having at least one recess formed therein;

a deck spanning said hulls and connected to each hull, a portion of said deck being adapted to fit within each of said recesses, said deck having at least two tabs formed thereon, each tab having a slot extending therethrough with at least one tab being positionable within a recess found on each hull;

a first and second strap attached to each of said hulls, each of said first straps being extendable through said slot on one of said tabs, each of said second straps including fastening means for fastening said first strap to said second strap;

a housing rotatably mounted to said deck;

a depending board attached to said housing for steering and stabilizing said catamaran, there being no other steering or stabilizing board affixed to said deck between said hulls for depending into water on which the catamaran sails; and a tiller integral with said housing and extending over said deck, said tiller being movable by a user of the catamaran for rotating said housing and said board about an axis substantially perpendicular to the direction of travel to the catamaran.

8. The catamaran as defined in claim 7 wherein said deck has an upper and lower surface, wherein said lower surface has at least two projections extending therefrom, each of said recesses on each hull including at least one cavity adapted to receive at least one of said projections.

9. The catamaran as defined in claim 7 wherein each tab has at least one projection extending thereform, each of said recesses on said hulls having at least one cavity adapted to receive at least one of said projections.

10. The catamaran as defined in claim 9 wherein each tab has a protective recess formed therein for protectively housing said fastening means.

11. The catamaran as defined in claim 10 wherein said fastening means comprises a seat belt type buckle.

* * * * *